US006347758B1

(12) United States Patent
Mizak et al.

(10) Patent No.: US 6,347,758 B1
(45) Date of Patent: Feb. 19, 2002

(54) STRAIN RELIEF MAIN SHAFT

(75) Inventors: Ronald D. Mizak; Robert R. Piepho, both of Wadsworth, OH (US)

(73) Assignee: The Babcock & Wilcox Company, New Orleans, LA (US)

( * ) Notice: Subject to any disclaimer, the term of this patent is extended or adjusted under 35 U.S.C. 154(b) by 0 days.

(21) Appl. No.: 08/898,606

(22) Filed: Jul. 22, 1997

(51) Int. Cl.[7] ..... B02C 2/04

(52) U.S. Cl. ..... 241/207; 241/209; 241/215

(58) Field of Search ..... 241/103, 107, 241/110, 207, 209, 215

(56) References Cited

U.S. PATENT DOCUMENTS

| | | | | | |
|---|---|---|---|---|---|
| 1,849,871 | A | * | 3/1932 | Green et al. | 241/103 |
| 2,595,587 | A | * | 5/1952 | Leach | 241/103 |
| 3,093,327 | A | * | 6/1963 | Harvey et al. | 241/103 |
| 3,666,188 | A | * | 5/1972 | Lippmann | 241/213 |
| 3,850,376 | A | * | 11/1974 | Mertz | 241/207 |
| 4,410,143 | A | * | 10/1983 | Polinski | 241/209 |

* cited by examiner

*Primary Examiner*—John M. Husar
(74) *Attorney, Agent, or Firm*—Eric Marich

(57) ABSTRACT

An improved main shaft and assembly for a coal pulverizer having a circumferential groove at a predetermined location on the main shaft and in the yoke bushing to provide improved fretting resistance to reduce the occurrence of main shaft failure.

19 Claims, 10 Drawing Sheets

STRAIN RELIEF MAIN SHAFT

BACKGROUND OF THE INVENTION

1. Field of the Invention

The present invention relates in general to an improved strain relief main shaft assembly for a coal pulverizer, and more particularly to an improved strain relief main shaft for use in Type E and EL pulverizers manufactured by The Babcock & Wilcox Company (B&W).

2. Description of the Related Art

FIG. 1 shows a cross section of a B&W type EL pulverizer generally depicted as numeral (2). These devices are used to crush coal for burning in a furnace or boiler. This type of pulverizer has a stationary top ring (4), one rotating bottom ring (6), and one set of balls (8) that comprise the grinding elements. The pressure required for efficient grinding is obtained from externally adjustable dual purpose springs (10). The bottom ring (6) is driven by the yoke (12) which is attached to a vertical main shaft assembly (14) of the pulverizer. The top ring (4) is held stationary generally by the dual purpose springs (10). Raw coal is fed into the grinding zone where it mixes with partially ground coal that forms a circulating load. Pulverizer air causes the coal to circulate through the grinding elements where some of it is pulverized in each pass through the row of balls (8). As the coal becomes fine enough to be picked up by the air it is carried to the classifier where coal of a desired fineness is separated from the stream entering the classifier and is carried out with the air. Oversized material is returned to the grinding zone.

The pulverizer is driven by spiral bevel gears (15) positioned on horizontal pinion shaft (16) and the vertical mainshaft (14) located in the base. Both the vertical main shaft (14) and the horizontal pinion shaft (16) are mounted in roller bearings. Forced lubrication is provided for the entire gear drive by an oil pump (13) submerged in the oil reservoir and gear-driven from the pinion shaft.

Currently, there is some concern as to main shaft (14) failure. It is believed that the failures occur because of bending fatigue originating at fretted surfaces in the lower contact land with the yoke bushing bore. Fretting damage, sometimes referred to as fretting corrosion, is a condition of surface deterioration brought on by very small relative movements between bodies in contact. The fit between the yoke bushing and main shaft is an interference type fit. This type fit generates a stress concentration or multiplier. The pulverizer design generates cyclic or alternating type bending loads in the top end of the main shaft. Because the loads are cyclic, rubbing or fretting corrosion will occur. Also of concern is fatigue failure when stress concentration, cyclic loading and fretting corrosion are combined. Like fretting, fatigue has a definite set of characteristics which combine to identify this failure phenomenon. Pulverizer vibration usually results in high shaft stress levels and may have a role in main shaft failures. Vibration may be caused by abnormal grinding element wear such as out-of-round wear of balls or rings. Pulverizer vibration also will occur if proper air/fuel regulation for the burners is not provided.

Because of the foregoing, there have been many attempts to correct main shaft failure frequency such as employing an anti-seize compound at the taper joint, using a bushing with a undercut center portion, using full contact bushings with no undercut center portion, shot peening, and nitriding as a surface hardening process. Remedial efforts notwithstanding, even carefully fitted taper joints, when subjected to cyclic bending forces often exhibit vulnerability to fatigue failure of shafts because of fretting and strain produced within the assembly.

There still exists a need for an improved main shaft and assembly for these types of pulverizers; one that will provide improved fretting resistance to reduce shaft failure due to fretting-induced bending fatigue on ball-race race coal pulverizers.

SUMMARY OF THE INVENTION

The present invention is directed to solving the aforementioned problems with the prior art as well as others by providing an improved main shaft assembly that provides improved fretting resistance. The present invention comprises an improved main shaft and assembly which includes reducing local stresses in the shaft within the joint by reducing the relative movement. The main shaft is provided with a less rigid section of the shaft outside the joint. In another embodiment, the yoke bushing is provided with circumferential grooves for reducing relative movement.

An aspect of the present invention is to provide an improved main shaft for a coal pulverizer which is less susceptible to failure.

Another aspect of the present invention is to provide a main shaft with a circumferential groove of a predetermined depth and width outside the joint between the shaft and the bore of the yoke.

Still another aspect of the present invention is to provide an improved main shaft assembly employing a circumferentially grooved yoke bushing.

Yet another aspect of the present invention is to provide an improved main shaft assembly that is simple in design, rugged in construction, and economical to manufacture.

The various features of novelty which characterize the invention are pointed out with particularity in the claims annexed to and forming a part of this disclosure. For a better understanding of the invention, its operating advantages and specific aspects attained by its uses, reference is made to the accompanying drawings and descriptive matter in which the preferred embodiment of the invention is illustrated.

DESCRIPTION OF THE PREFERRED EMBODIMENTS

Figure 1:
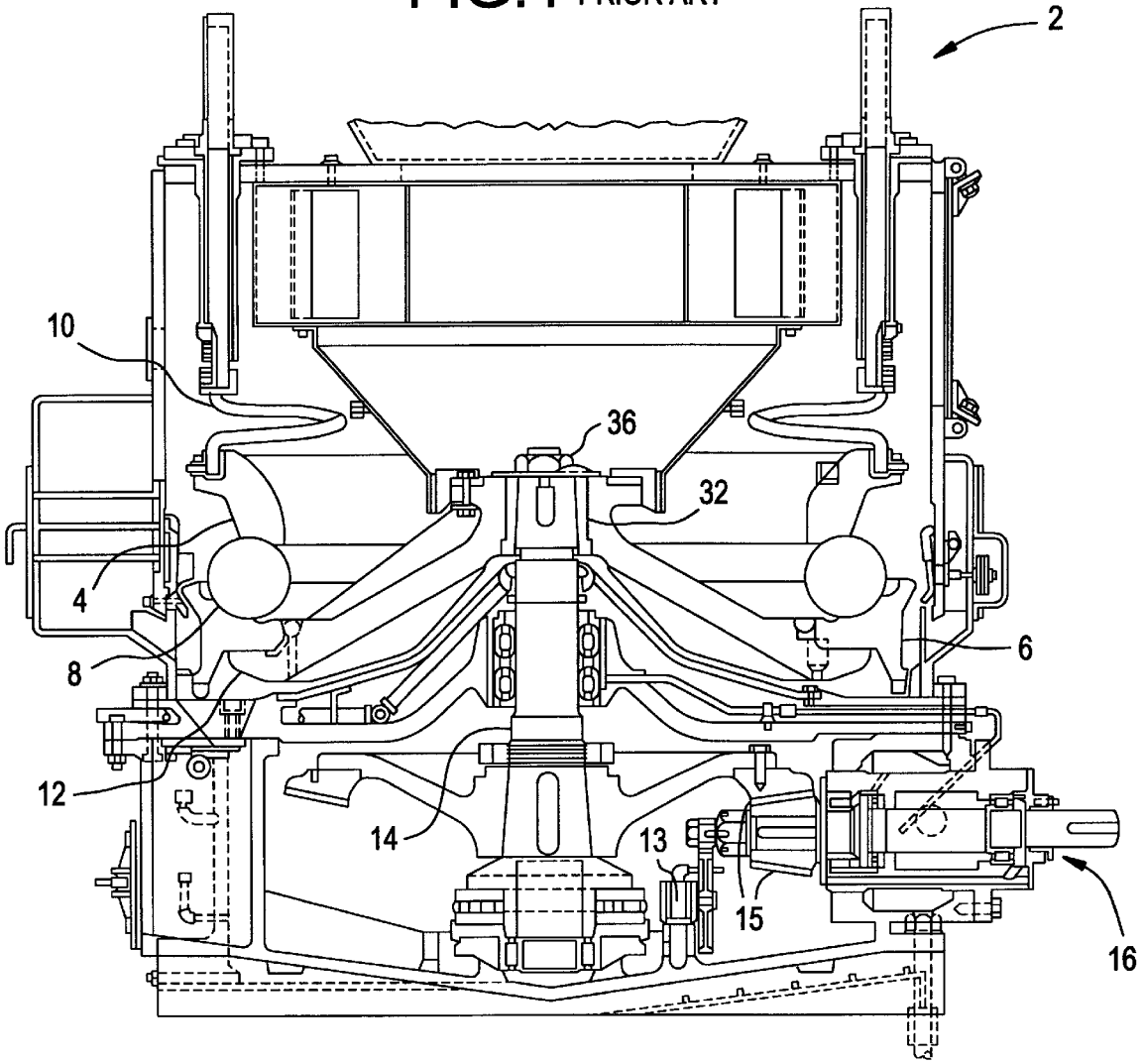
FIG. 1 PRIOR ART
FIG. 1 is a sectional view of a B&W type EL ball and race pulverizer.

The present invention resides in an improved main shaft and yoke assembly for a coal pulverizer to reduce shaft failure due to fretting induced bending fatigue.

A suitable material for a coal pulverizer shaft is, for example as presently used, AISI 4340 steel, quenched and tempered, followed by a subcritical quench to improve surface-layer properties. The material is vacuum degassed for cleanliness, minimizing inclusions which can serve as initiation sites for fatigue cracks.

The yoke end (20) of the shaft (14) includes the portion of the shaft starting at the gear center hold-down threads (24) to and including upper taper (25) of the shaft. (32)

The fit or joint between the yoke bushing (32) and upper taper (25) is an interference type fit. This type fit generates a stress concentration or a stress multiplier. This stress concentration increases when the interference fit increases.

The pulverizer operation generates cyclic or alternate type bending loads in the top end (20) of the main shaft (14). Shaft failures occur, most likely the result of deterioration of the finely machined shaft (14) surfaces within the joint between the shaft (25) and the bore of the yoke bushing (32). This deterioration may be caused by cyclic movement between the respective surfaces of the shaft and the yoke bushing bore. This movement results from bending of the shaft which produces differing stress fields in the shaft (14) and the yoke bushing (32). This movement gives rise to a progressive form of damage known as fretting.

Figure 3:
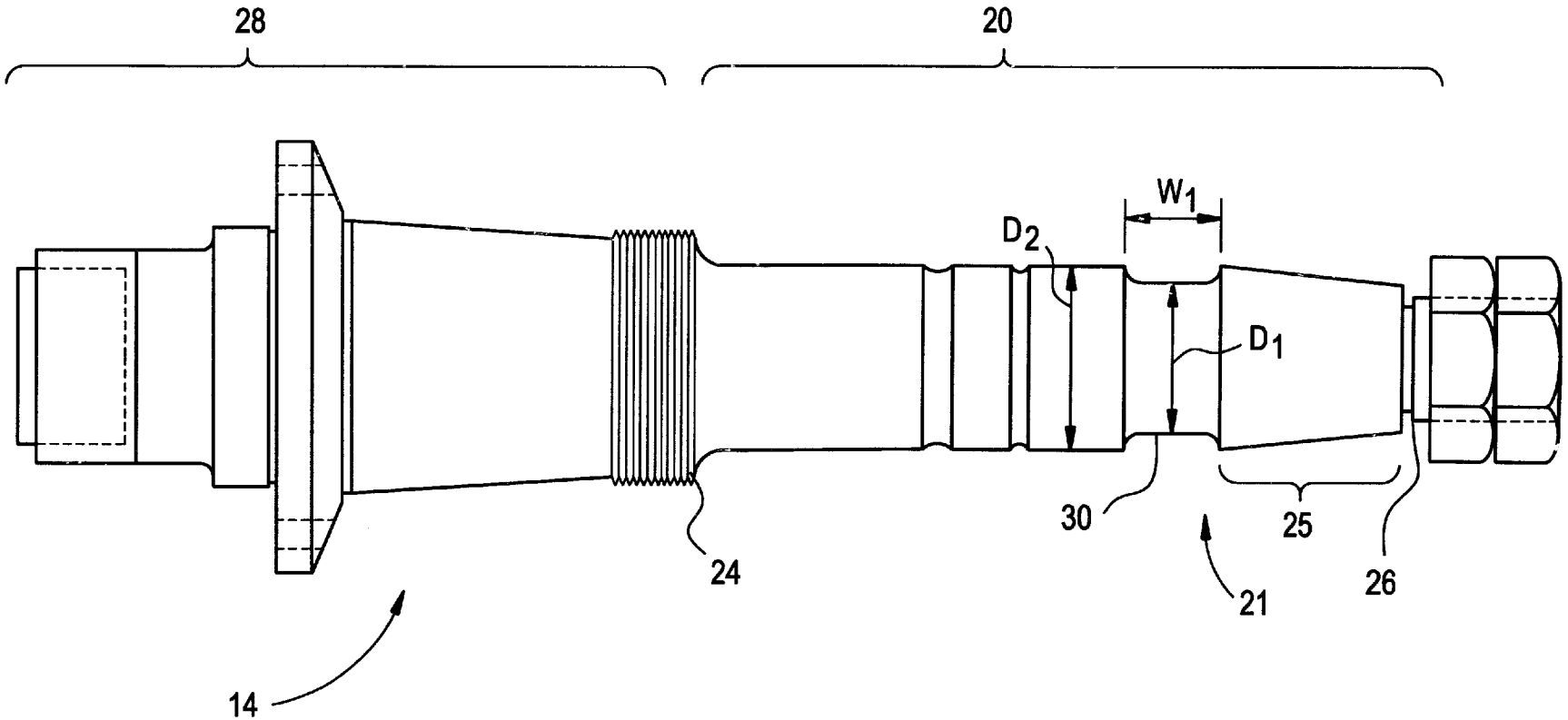
FIG. 3 is an external view of one embodiment according to the present invention of an improved main shaft.
Figure 4:
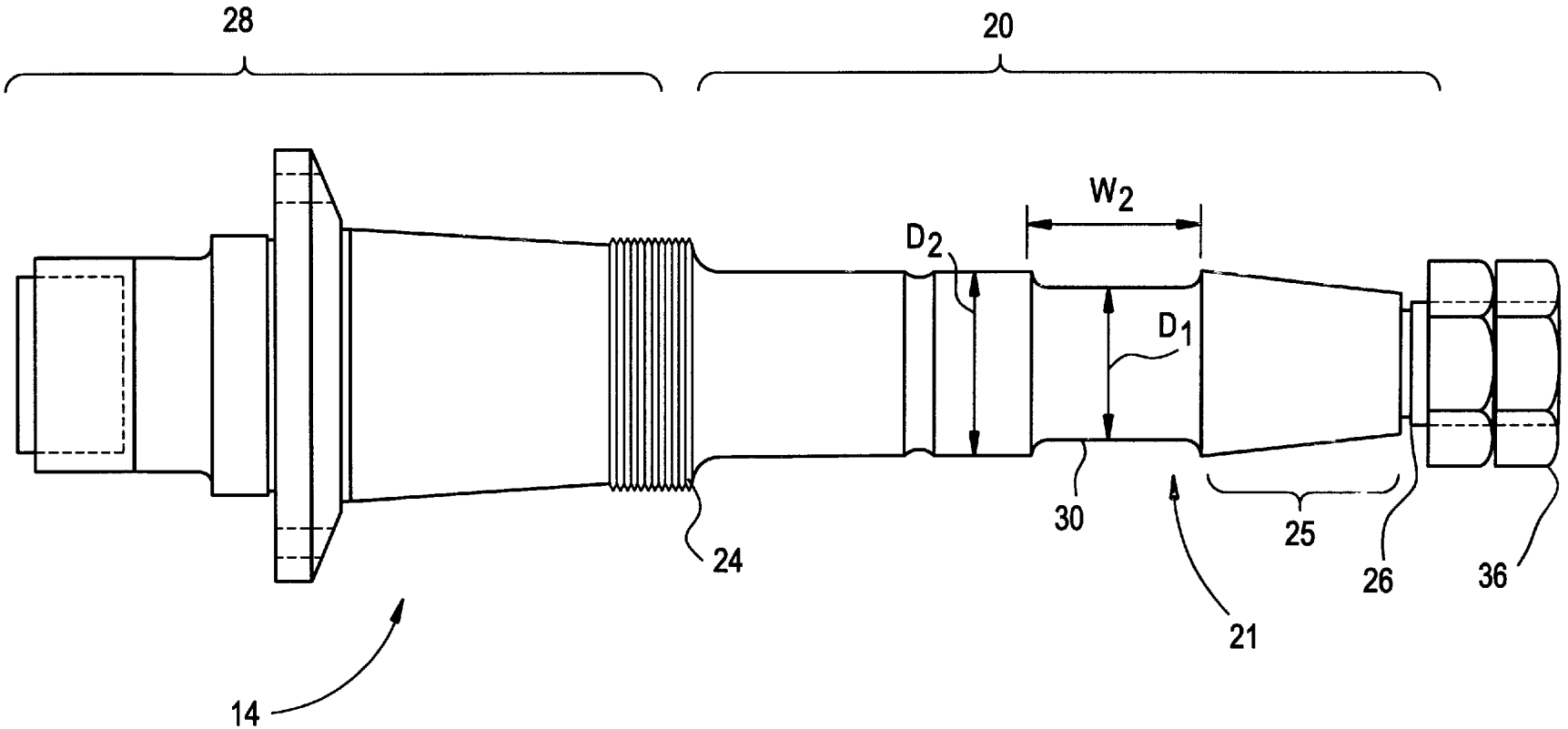
FIG. 4 is an external view of another embodiment of an improved main shaft.

The improved main shaft in accordance with the present invention reduces local stresses in the shaft (14) within the joint, i.e., portion (25) surrounded by yoke bushing (32) within the bore of yoke (12) thereby reducing or eliminating the relative movement. This is achieved by providing a section of shaft outside the joint which is significantly less rigid than the portion within the joint, thereby confining flexing to the less stiff section. The improved main shaft has a reduced diameter portion (21) significantly wider than the prior art groove (30) immediately below the yoke (12) and shaft (14) joint. This is the area immediately below the bore of the yoke (12). FIG. 3 shows a circumferential groove (30) having a predetermined depth and width $W_1$ in shaft (14) located immediately below the tapered portion (25). Preferably, the width $W_1$ groove (30) is approximately six and a quarter inches wide with a reduced diameter $D_1$ of about seven inches as compared with a diameter $D_2$ of about eight inches immediately adjacent groove (30). FIG. 4 shows a similar embodiment of shaft (14) but the circumferential groove (30) has a width $W_2$ of approximately eight inches wide with a reduced diameter $D_1$ similar to that of FIG. 3.

In the prior art shafts, groove (30) ranges in width from about 0.850 inches to about 1.3 inches depending on the model and shaft size. The depth of groove (30) ranges from about 0.100 inch to about 0.1575 inch.

Figure 5:
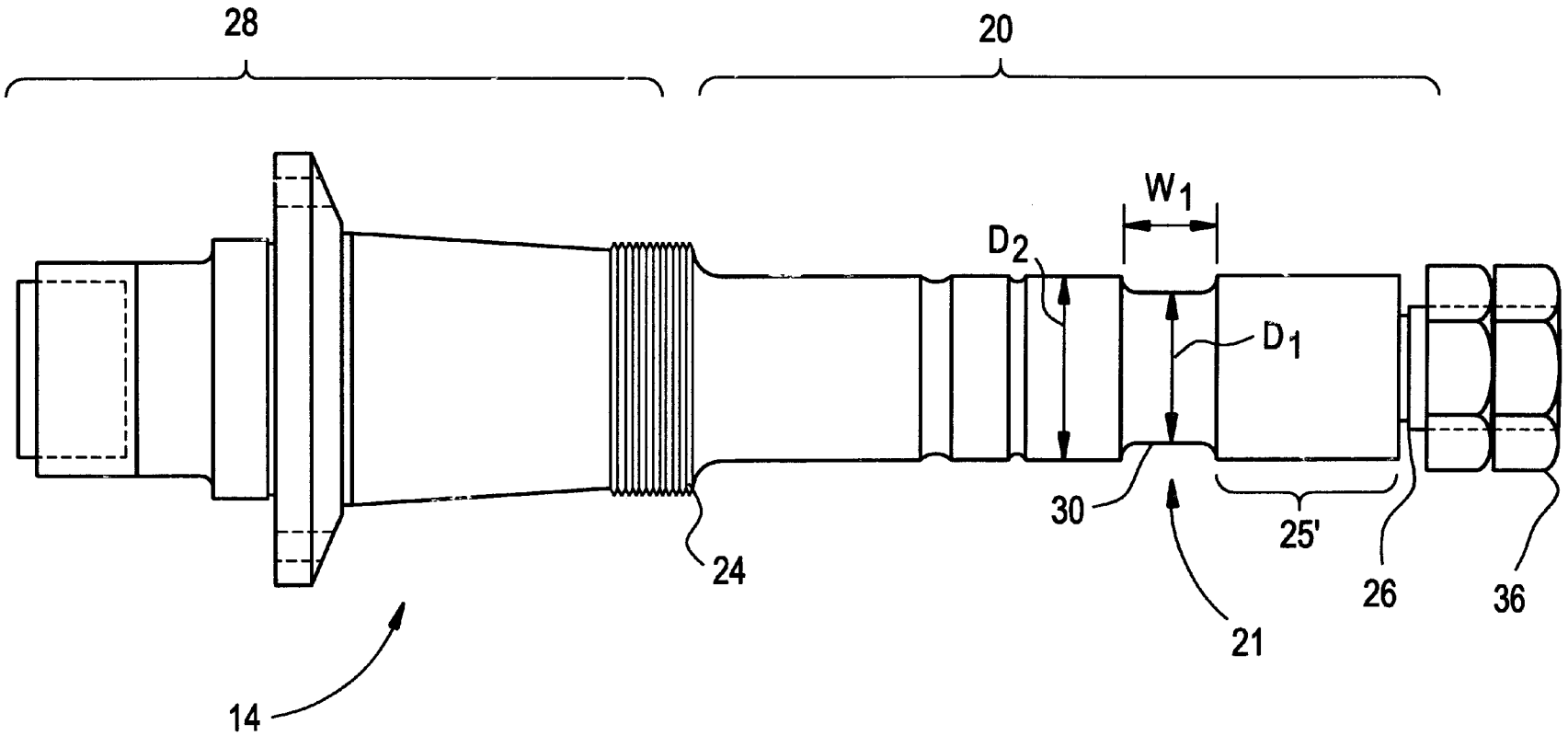
FIG. 5 is an external view of still another embodiment of an improved main shaft.
Figure 6:
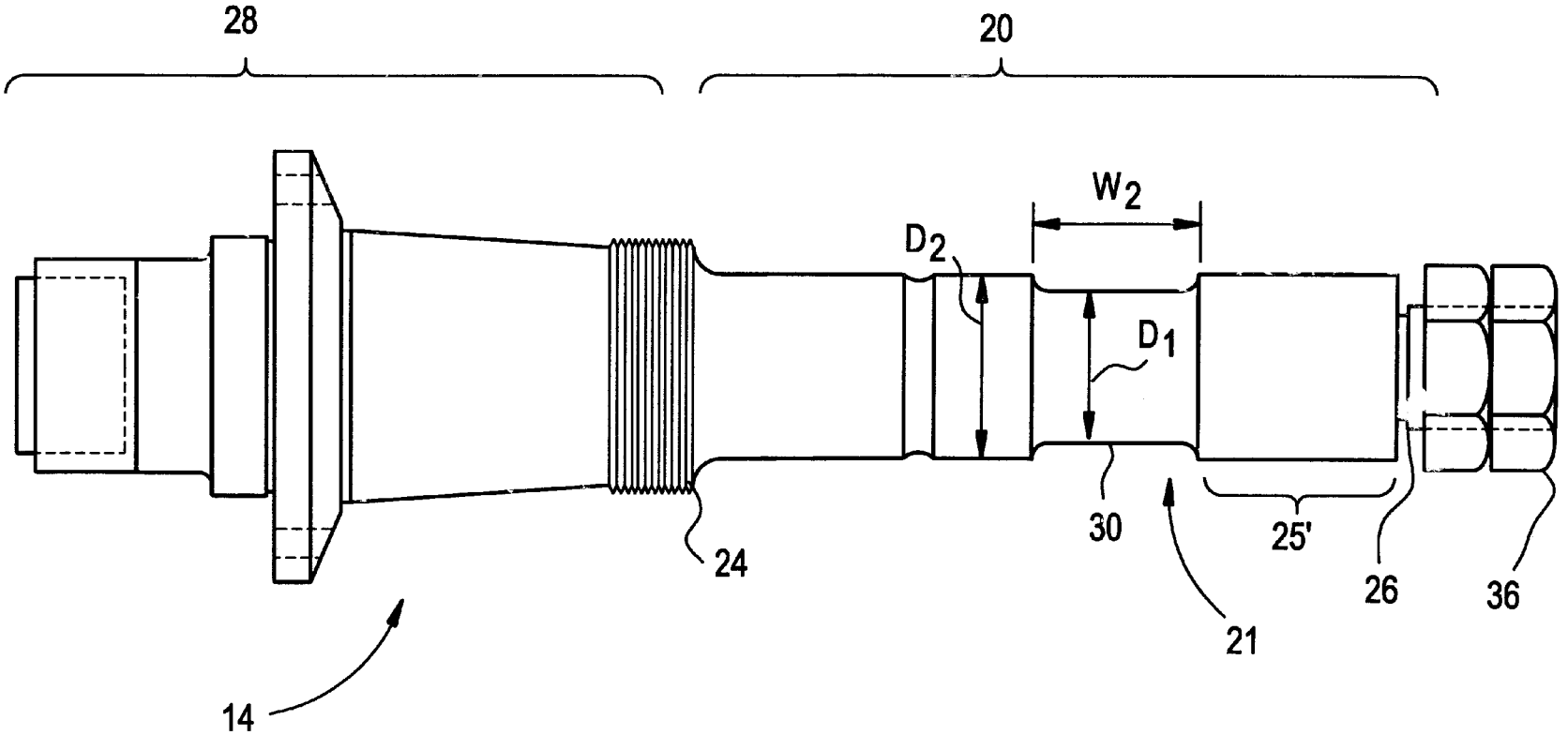
FIG. 6 is yet another embodiment of an improved main shaft.

The embodiment of FIG. 5 is also similar to that shown in FIG. 3 except for the cylindrical end (25'). The cylindrical shaft end (25') replaces the taper end (25). FIG. 6 is nearly identical to FIG. 4 except for the cylindrical end (25') replacing the taper end (25).

The improved main shaft in accordance with the present invention uses a shaft having a reduced diameter portion (21) immediately below the yoke/shaft joint. Preferably, this diameter reduction is at least about one inch or, for example, about seven inches in diameter compared to about eight inches nominal diameter at the joint.

With the reduced diameter section (21), a given load results in increased total deflection. At a given deflection, stress is concentrated in the more flexible section. The outcome raises the maximum stress outside the joint, but reduces the stress, and the axial, cyclic movement, within the joint which produces fretting.

The width of the circumferential groove (30) is dependent upon cooperating features in the main shaft assembly, such as the air-buffered dust seal and oil seal (not shown) situated in the axial space between the yoke/shaft joint and the bearing journal. These features are closely fit to the shaft and are designed to pass over the taper (25). If the shaft diameter at the locations of these features is smaller than at locations above and below, these features must be split diametrically for assembly at increased cost and complexity. The embodiment shown in FIG. 3 is more preferred since only the dust seal needs to be altered. This alteration would include a split dust seal.

Figure 7:
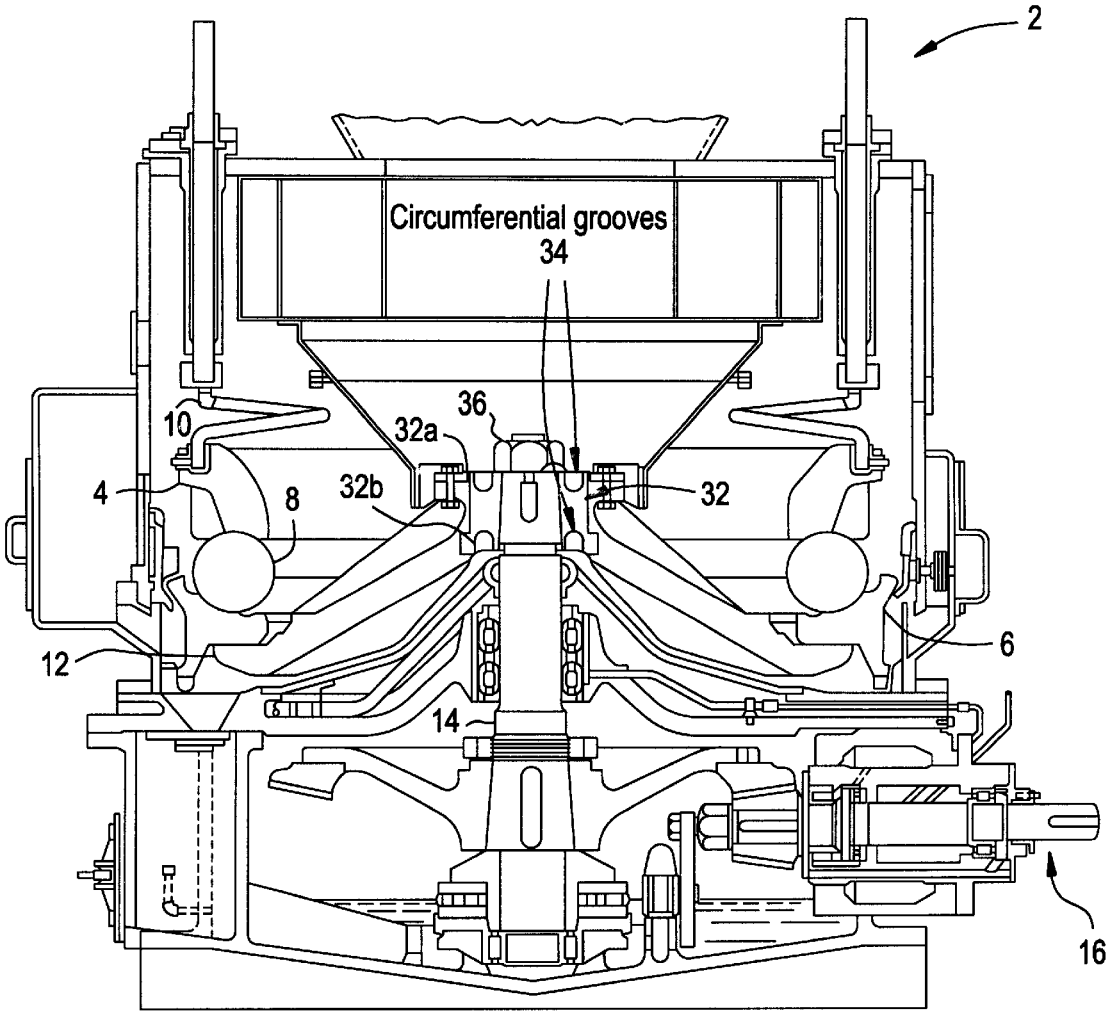
FIG. 7 is a view similar to FIG. 1 except that a circumferential grooved yoke bushing in accordance with the present invention is shown.
Figure 8:
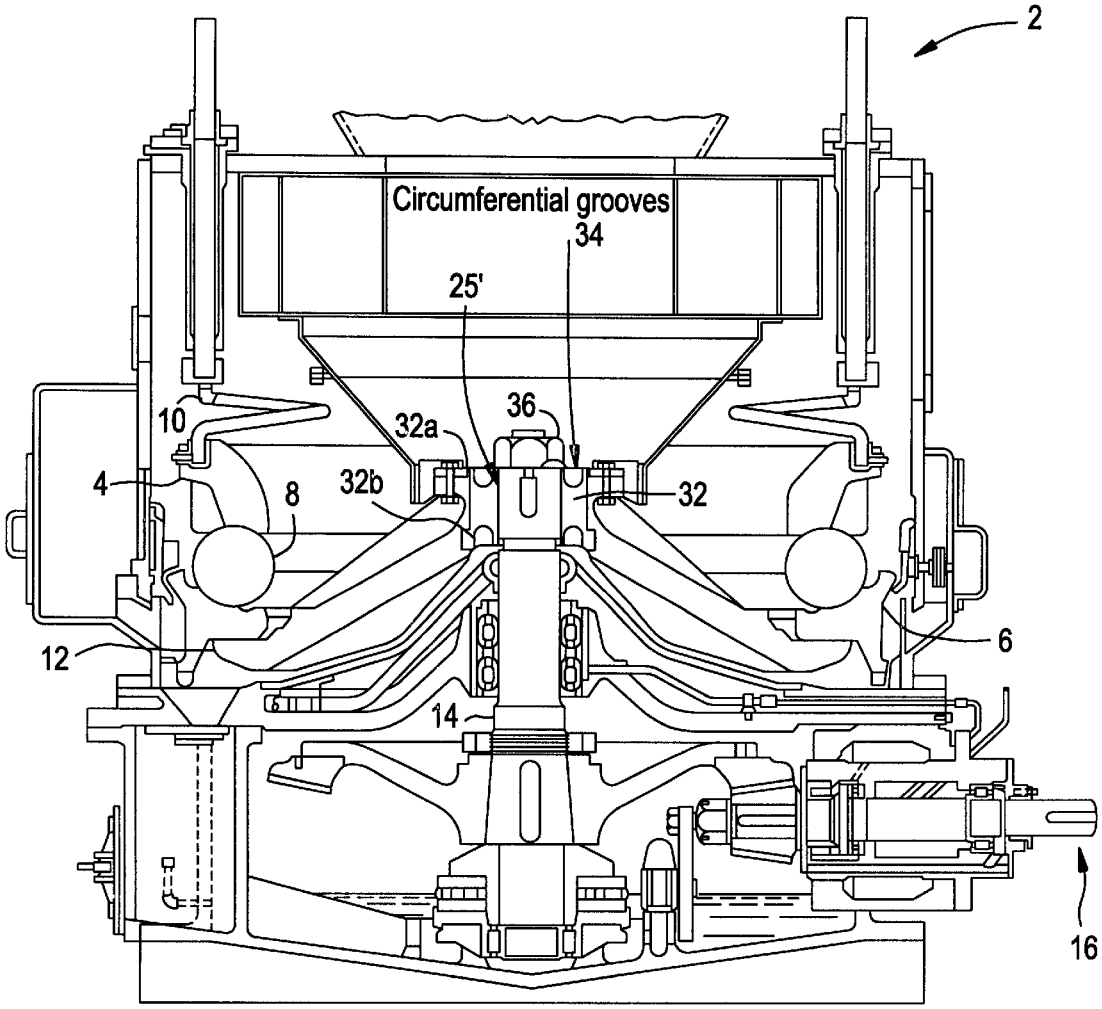
FIG. 8 is a view similar to FIG. 7 showing the circumferential grooved yoke bushing with a straight main shaft.
Figure 9B:
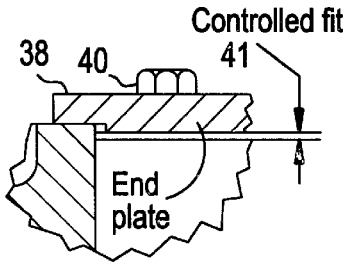
FIG. 9B is an enlarged view of a retainer plate of FIG. 9A.
Figure 9A:
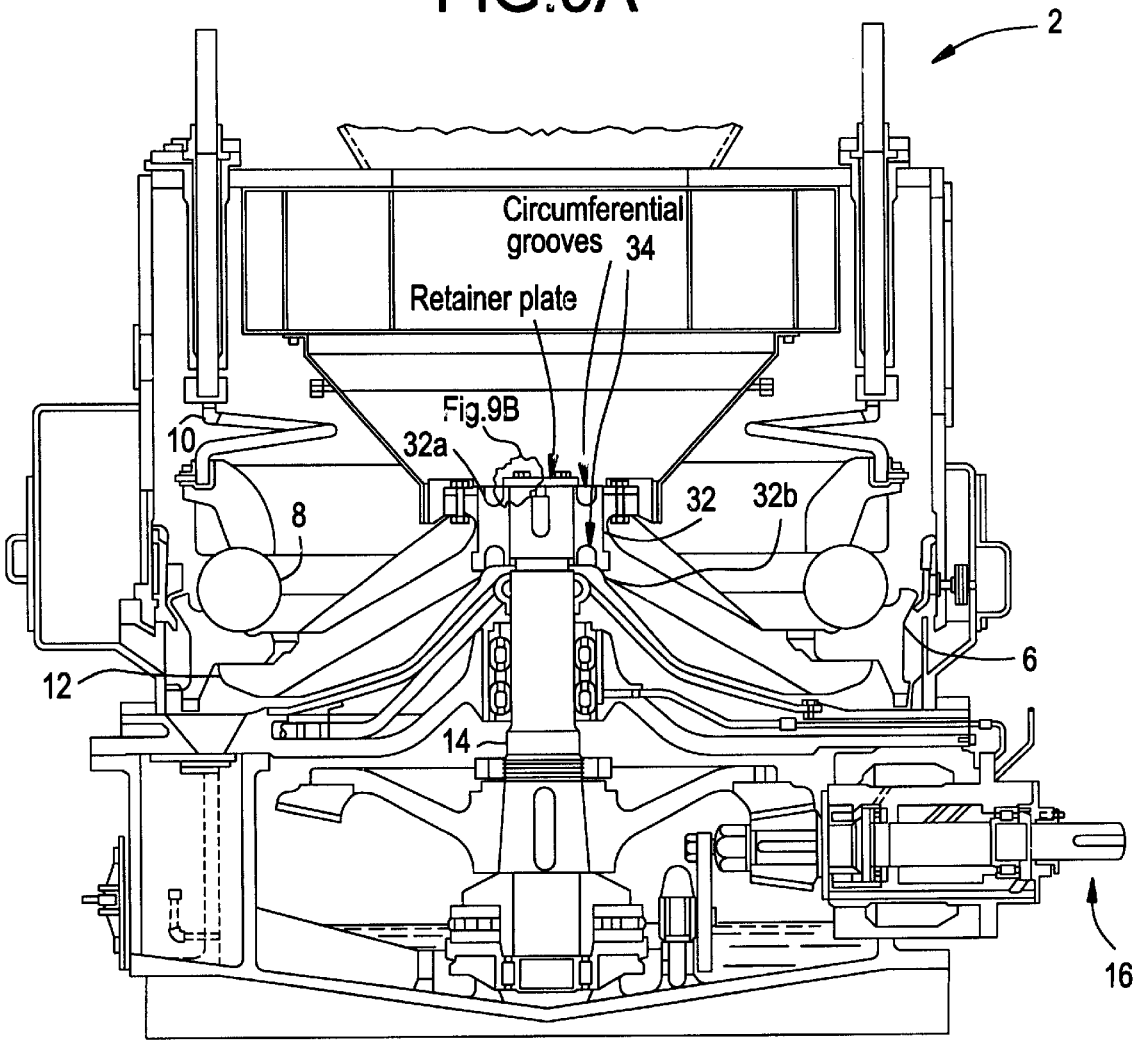
FIG. 9A is a view similar to FIG. 8.

The present invention is also directed to an improved main shaft assembly that provides a yoke bushing (32) with having a depth that is at least about one-fourth the length of the bushing circumferential grooves on the upper side **(32*a*) and bottom side (32*b*) of the yoke bushing. The circumferential groove (34) allows the solid length of the yoke bushing (32) to be reduced while still keeping good contact length. Additionally, the circumferential groove which may be tapered reduces the rigidity of the bushing and facilitates an increased degree of compliance in the bushing to shaft deflection. Advantageously, the yoke bushing (32) may be employed with 10 either a tapered end (25) main shaft (14) as seen in FIG. 7, or the straight (cylindrical) shaft design (25') shown in FIG. 8. FIG. 9 shows another embodiment similar to that in FIG. 8 except that the existing hold down nut (36) on the threaded portion (26) of the shaft (14) is replaced with a retainer plate (38) and one or more fasteners (40). Fasteners (40) can include any type of fastening means but preferably is a bolt or cap screw. FIG. 9B is an enlarged view of the retainer plate of FIG. 9**A.

Figure 10B:
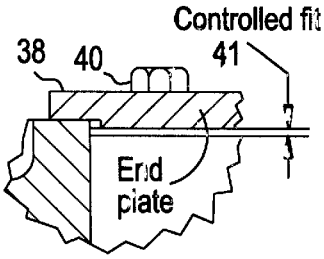
FIG. 10B is an enlarged view of a retainer plate of FIG. 10A.
Figure 10A:
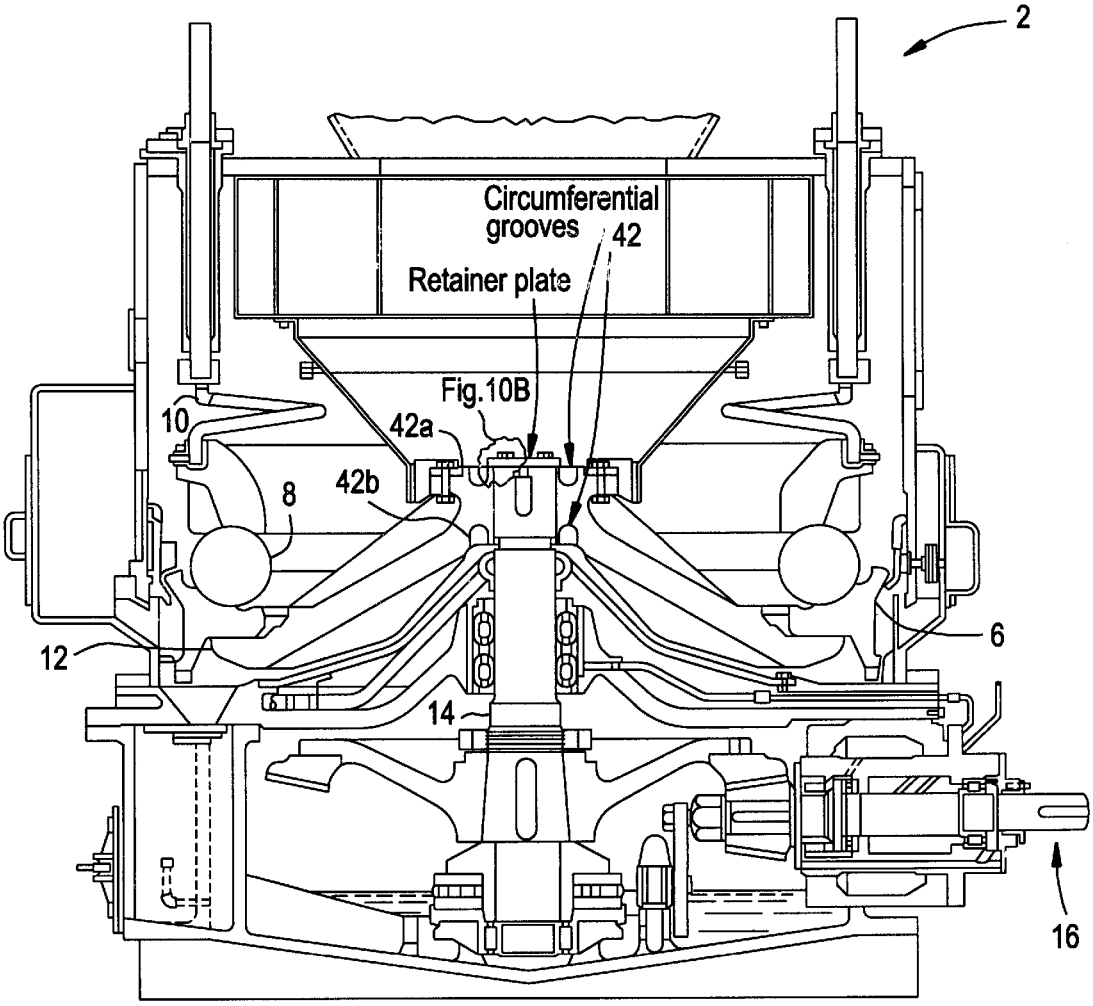
FIG. 10A is a view similar to FIG. 9 of still another alternate embodiment.

The present invention may also be utilized directly in the yoke (12) itself without the use of a yoke bushing. In the embodiment shown in FIG. 10, a circumferential groove (42) having a depth of at least about one-fourth the length of axial engagement is positioned directly in the yoke (12) on its upper side **(42*a*) and its lower side (42*b*). FIG. 10A also illustrates a retainer plate (38) and fastener (40) with a controlled fit (41) which is a predetermined gap between the end of shaft (14) and bottom surface of retainer plate (38) holds the yoke (12) in place on shaft (14)**.

While a single circumferential groove has been shown on the upper and lower sides of the yoke bushing (32) or yoke (12), it is understood that multiple circumferential grooves may also be used on each side. Also, the grooves may be any shape, or having various depths. Similarly on the main shaft (14) multiple circumferential grooves may be used rather than a single one.

Figure 2:
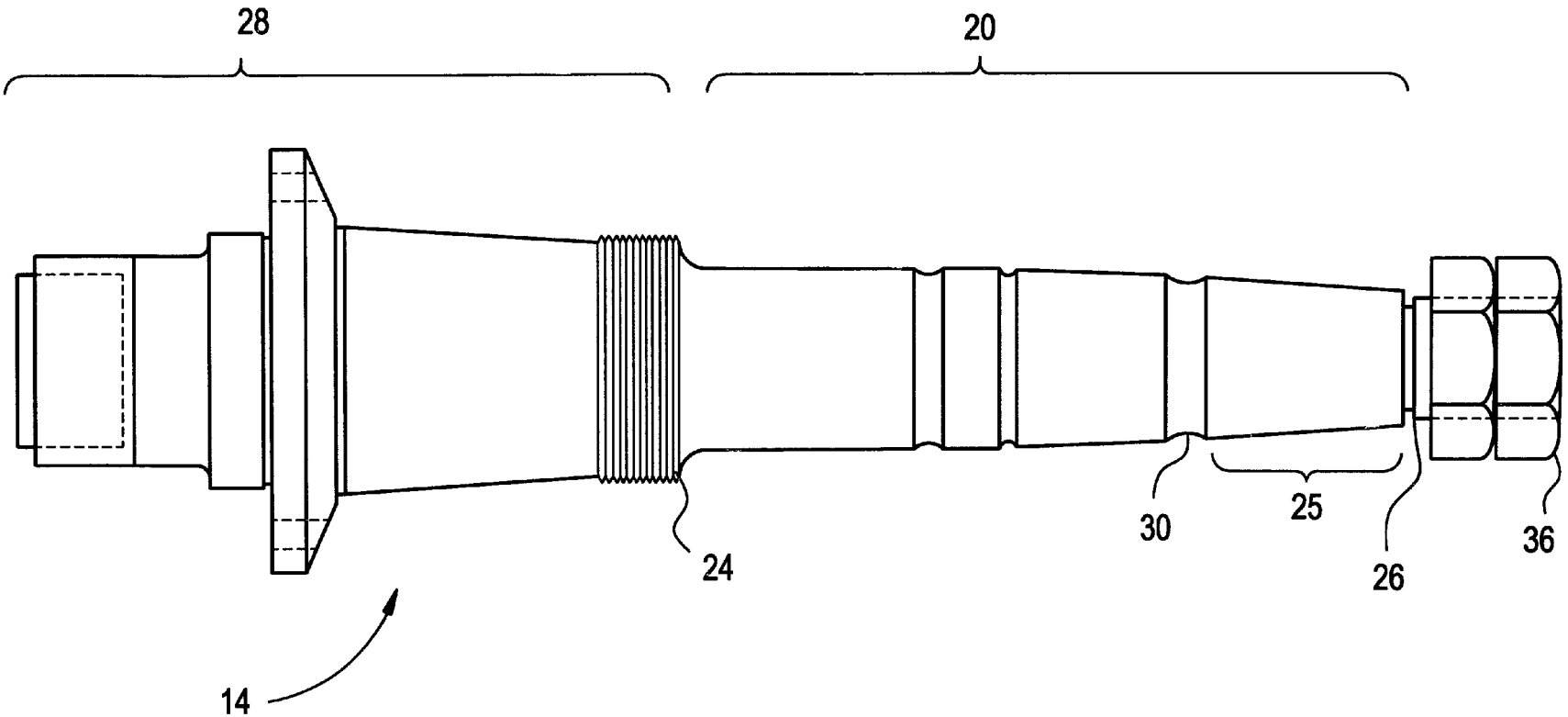
FIG.2 PRIOR ART
FIG. 2 is an external view of a main shaft employed in such a pulverizer.

The improved yoke bushing (32) and/or yoke (12) advantageously may be employed in conjunction with the improved main shaft of the present invention to provide an improved main shaft assembly. They also may be used in retrofit applications separately with a regular main shaft as shown in FIG. 2.

While specific embodiments of the invention have been shown and described in detail to illustrate the application of the principles of the invention, it will be understood that the invention may be embodied otherwise without departing from such principles.

We claim:

1. An improved main shaft for a coal pulverizer, wherein the improvement comprises a circumferential groove situated in the main shaft adjacent a yoke end below a yoke/shaft joint, wherein the circumferential groove has a width of approximately 6 and a quarter inches and provides a diameter reduction of at least about one inch compared to a nominal diameter of the main shaft.

2. The improved main shaft as recited in claim 1, wherein the circumferential groove has a reduced diameter of about seven inches and the main shaft has a nominal shaft diameter of about eight inches.

3. The improved main shaft as recited in claim 2, wherein the yoke end is a tapered yoke end.

4. The improved main shaft as recited in claim 2, wherein the yoke end is a cylindrical yoke end.

5. The improved main shaft as recited in claim 1, wherein the yoke end is a tapered yoke end and the main shaft has a shaft diameter ranging from about six to about nine inches.

6. The improved main shaft as recited in claim 1, wherein the yoke end is a cylindrical yoke end and the main shaft has a shaft diameter ranging from about six to about nine inches.

7. An improved main shaft for a coal pulverizer, wherein the improvement comprises a circumferential groove situated in the main shaft adjacent a yoke end, wherein the circumferential groove has a width of approximately eight inches and provides a diameter reduction of at least about one inch compared to a nominal diameter of the main shaft.

8. The improved main shaft as recited in claim 7, wherein the circumferential groove has a reduced diameter of about seven inches.

9. An improved yoke bushing having a bore constructed to receive a main shaft for a coal pulverizer, comprising:

a circumferential groove situated on an upper and bottom side of the yoke bushing.

10. The improved yoke bushing as recited in claim 9, wherein the bore of the yoke bushing includes a taper which tapers inwardly towards the upper side.

11. The improved yoke bushing as recited in claim 9, wherein the bore of the yoke bushing is cylindrical.

12. An improved yoke having a bore constructed to receive a main shaft for a coal pulverizer, wherein the improvement comprises a circumferential groove on an upper and bottom side of the yoke.

13. An improved main shaft assembly for a coal pulverizer, comprising:

a main shaft having a circumferential groove positioned in the main shaft adjacent a yoke end; and a yoke bushing having a bore constructed to fit on the yoke end of the main shaft, said yoke bushing having a circumferential groove on an upper and a bottom side of the yoke bushing.

14. The improved main shaft assembly as recited in claim 13, wherein the yoke end of said main shaft includes a taper that tapers inwardly towards an upper side and the main shaft has a diameter ranging from about six to about nine inches.

15. The improved main shaft assembly as recited in claim 14, wherein the circumferential groove positioned in the main shaft is approximately six and a quarter inches wide.

16. The improved main shaft assembly as recited in claim 14, wherein the circumferential groove positioned in the main shaft is approximately eight inches wide.

17. The improved main shaft assembly as recited in claim 13, wherein the yoke end of said main shaft is cylindrical and the main shaft has a diameter ranging from about six to about nine inches.

18. The improved main shaft as recited in claim 17, wherein the circumferential groove positioned in the main shaft is approximately six and a quarter inches wide.

19. The improved main shaft assembly as recited in claim 17, wherein the circumferential groove positioned in the main shaft is approximately eight inches wide.

* * * * *